US007407920B2

(12) United States Patent
Olson et al.

(10) Patent No.: US 7,407,920 B2
(45) Date of Patent: Aug. 5, 2008

(54) OVERBASED CALCIUM SALICYLATE GREASES

(75) Inventors: William D. Olson, Toronto (CA); Ronald J. Muir, West Hill (CA); Wayne MacKwood, Ajax (CA)

(73) Assignees: Crompton Corporation, Middlebury, CT (US); Crompton Co. /Cle, Elmira, Ontario (CA)

( * ) Notice: Subject to any disclaimer, the term of this patent is extended or adjusted under 35 U.S.C. 154(b) by 772 days.

(21) Appl. No.: 10/911,132

(22) Filed: Jul. 29, 2004

(65) Prior Publication Data

US 2006/0025317 A1 Feb. 2, 2006

(51) Int. Cl.
*C10M 159/20* (2006.01)
*C10M 169/06* (2006.01)

(52) U.S. Cl. ..... 508/460; 508/156; 508/158; 508/180

(58) Field of Classification Search ..... 508/460
See application file for complete search history.

(56) References Cited

U.S. PATENT DOCUMENTS

| | | | | |
|---|---|---|---|---|
| 3,242,079 | A | 3/1966 | McMillen | 252/33 |
| 3,372,115 | A | 3/1968 | McMillen | 252/33 |
| 3,376,222 | A | 4/1968 | McMillen | 252/33 |
| 3,377,283 | A | 4/1968 | McMillen | 252/33 |
| 3,492,231 | A | 1/1970 | McMillen | 252/33 |
| 3,523,898 | A | 8/1970 | De Vault | 252/33 |
| 3,661,622 | A | 5/1972 | Rogers | 117/75 |
| 3,671,012 | A | 6/1972 | Scott et al. | 252/33.4 |
| 3,730,895 | A | 5/1973 | Kjonaas | 252/18 |
| 3,746,643 | A | 7/1973 | Rogers | 252/33 |
| 3,816,310 | A | 6/1974 | Hunt | 252/32.7 |
| 4,560,489 | A | 12/1985 | Muir et al. | 252/33.4 |
| 4,719,023 | A | 1/1988 | MacPhail et al. | |
| 5,256,320 | A * | 10/1993 | Todd et al. | 508/398 |
| 5,259,966 | A * | 11/1993 | Burke et al. | 508/397 |
| 5,308,514 | A | 5/1994 | Olson et al. | 252/18 |
| 5,338,467 | A | 8/1994 | Olson et al. | 252/33.4 |
| 6,107,259 | A * | 8/2000 | Muir et al. | 508/393 |
| 6,639,090 | B2 * | 10/2003 | Ramey et al. | 554/156 |
| 7,163,912 | B2 * | 1/2007 | Ramey et al. | 508/460 |

FOREIGN PATENT DOCUMENTS

| | | |
|---|---|---|
| EP | 0580335 A1 | 1/1994 |
| EP | 0974638 A1 | 1/2000 |

* cited by examiner

*Primary Examiner*—Ellen M. McAvoy
(74) *Attorney, Agent, or Firm*—Jaimes Sher

(57) ABSTRACT

A process and composition for forming a non-Newtonian oil composition in the form of a grease comprising an overbased calcium salicylate and solid particles of colloidally dispersed calcium carbonate in the form of calcite is disclosed wherein the process comprises the steps of heating overbased calcium salicylate, amorphous calcium carbonate, and a converting agent comprising a fatty acid of twelve to twenty-four carbon atoms in an oleaginous medium, and then adding sufficient water, alcohol, and carbon dioxide to the mixture to complete the conversion of the amorphous calcium carbonate to calcite.

7 Claims, No Drawings

OVERBASED CALCIUM SALICYLATE GREASES

BACKGROUND OF THE INVENTION

1. Field of the Invention

This invention relates to high performance overbased calcium salicylate greases, the preparation of these greases and intermediates. More particularly, this invention relates to a process of forming a non-Newtonian oil composition in the form of a grease comprising an overbased calcium salicylate and solid particles of colloidally dispersed calcium carbonate in the form of calcite which comprises heating overbased calcium salicylate, amorphous calcium carbonate, and a converting agent comprising a fatty acid of twelve to twenty-four carbon atoms in an oleaginous vehicle, and then adding sufficient carbon dioxide to complete the conversion of the amorphous calcium carbonate to calcite.

2. Description of Related Art

As pointed out in U.S. Pat. No. 4,560,489, thixotropic greases or grease-like overbased calcium sulfonate compositions have corrosion-inhibiting properties and have utility for a variety of uses such as, for instance, in automobile and truck body undercoating, and for various other purposes known to the art and are disclosed in various publications and patents, such as U.S. Pat. Nos. 3,242,079; 3,372,115; 3,376,222; 3,377,283; 3,523,898; 3,661,622; 3,671,012; 3,746,643; 3,730,895; 3,816,310; and 3,492,231. Such greases or grease-like compositions have gone into wide-spread use either as such, or mixed with other ingredients to produce compositions for use in a variety of environments and, generally speaking, they are characterized by reasonably good E.P. & Antiwear Properties, high dropping points, reasonably good resistance to mechanical breakdown and salt spray- and water-corrosion, thermal stability at high temperatures, and other desirable properties.

As is well known, greases are sold in various grades depending upon the softness of the grease. The softer the grease the more fluid it is. Typically, these greases are rated or graded on the basis of their worked cone penetration range. For example, greases sold under the designation grade zero have a cone penetration number from about 355 to 385, those having a cone penetration range of 310 to 340 are designated grade one, and the most widely sold greases have a cone penetration range of 265 to 295 and are designated grade two. The lower the grade of the grease the more relatively inexpensive oleaginous vehicle and the cheaper the grease. For the purposes of this invention, cone penetration is measured by the ASTM cone penetration test (D217). Penetration is the depth, in tenths of a millimeter, to which a standard cone sinks into the grease under prescribed conditions. Thus, higher penetration numbers indicate softer greases, since the cone has sunk deeper into the sample.

The greases disclosed in U.S. Pat. No. 4,560,489 can be prepared by one step or two step processes. In the one step process, neutral calcium sulfonate, hydrated lime, lubricating oil, a converting agent capable of converting amorphous calcium carbonate into crystalline calcium carbonate, and a catalyst suitable for promoting carbonation of the neutral calcium sulfonate, such as methanol, are carbonated to form a non-Newtonian highly overbased calcium sulfonate solution. Additional oil stock, lime, water, boric acid, and fatty acid are then added to complete the production of the overbased calcium sulfonate grease. In the two step process, a composition comprising a Newtonian highly overbased calcium sulfonate solution is first converted to a thickened intermediate non-Newtonian product by initial treatment thereof with a converting agent such as acetic acid, propionic acid, or an alcohol. Then, there is subsequently added thereto, at elevated temperatures, boric acid in admixture with, or dissolved or partially dissolved in, hot water, lime, or calcium hydroxide and the soap-forming aliphatic monocarboxylic or fatty acid such as a $C_{12}$ to $C_{24}$ acid. In both the one step and two step processes, the soap-forming aliphatic monocarboxylic acid or fatty acid containing from 12 to 24 carbon atoms is added to the non-Newtonian highly overbased calcium sulfonate solution containing calcium carbonate in the calcite form.

U.S. Pat. No. 5,308,514 discloses high performance overbased calcium sulfonate greases comprising up to about 28% by weight overbased calcium sulfonate, solid particles of colloidally dispersed calcium carbonate essentially in the form of calcite, a calcium soap of a fatty acid of twelve to twenty-four carbon atoms, and oleaginous vehicle wherein at a concentration of about 28% by weight overbased calcium sulfonate said greases have a worked cone penetration rating of less than about 295.

U.S. Pat. No. 5,338,467 discloses a process of forming a non-Newtonian oil composition in the form of a grease comprising an overbased calcium sulfonate and solid particles of colloidally dispersed calcium carbonate in the form of calcite which comprises heating overbased calcium sulfonate, amorphous calcium carbonate and a converting agent comprising a fatty acid of twelve to twenty-four carbon atoms in an oleaginous medium.

The disclosures of the foregoing are incorporated herein by reference in their entirety.

SUMMARY OF THE INVENTION

In one aspect, the present invention is a non-Newtonian composition comprising overbased calcium salicylate, amorphous calcium carbonate, a fatty acid of twelve to twenty-four carbon atoms, and an oleaginous media.

In a second aspect this invention comprises a process for forming a non-Newtonian composition in the form of a grease comprising an overbased salicylate, colloidally dispersed calcium carbonate in the form of crystalline solids of calcite wherein the process comprises the steps of heating a Newtonian composition comprising overbased calcium salicylate, amorphous calcium carbonate, an oleaginous vehicle and a converting agent comprising a fatty acid of 12 to 24 carbon atoms and adding to the composition sufficient water, alcohol, and carbon dioxide to complete the conversion of the amorphous calcium carbonate to calcite.

More particularly, the present invention is directed to a process for forming a non-Newtonian oil composition in the form of a grease comprising an overbased calcium salicylate and solid particles of colloidally dispersed calcium carbonate in the form of calcite wherein the process comprises the steps of heating overbased calcium salicylate, amorphous calcium carbonate, and a converting agent comprising a fatty acid of twelve to twenty-four carbon atoms in an oleaginous medium, and then adding sufficient water, alcohol, and carbon dioxide to the mixture to complete the conversion of the amorphous calcium carbonate to calcite.

In another aspect, the present invention is directed to a process for forming a non-Newtonian oil composition in the form of a grease comprising an overbased calcium salicylate, solid particles of colloidally dispersed calcium carbonate in the form of calcite, and calcium borate wherein the process comprises the steps of (1) heating overbased calcium salicylate, amorphous calcium carbonate, and a combination of converting agents comprising water, alcohol, and carbon dioxide and a fatty acid of twelve to twenty-four carbon atoms in an oleaginous vehicle under conditions favoring the formation of calcium carbonate crystals in the form of calcite crystals, and (2) reacting said product of step 1 with components comprising a boric acid compound to develop the grease like properties.

In still another aspect, the present invention is directed to a non-Newtonian composition comprising overbased calcium salicylate, amorphous calcium carbonate, and a fatty acid of twelve to twenty-four carbon atoms in an oleaginous media.

DESCRIPTION OF THE PREFERRED EMBODIMENTS

The general object of this invention can be attained by a process of forming a non-Newtonian oil composition in the form of a grease comprising an overbased calcium salicylate, colloidally dispersed calcium carbonate in the form of calcite wherein the process comprises heating a composition comprising overbased calcium salicylate, amorphous calcium carbonate, an oleaginous vehicle, and a converting agent comprising a fatty acid of 12 to 24 carbon atoms and then adding sufficient water, alcohol, and carbon dioxide to the heated mixture to complete the conversion of the amorphous calcium carbonate to calcite. The full properties of the grease are then preferably developed by boration.

The calcite crystal form produces non-Newtonian rheology, enhances yield, and adds to the high temperature properties of the grease.

Grade 2 greases can be prepared by the process of this invention containing less than 35% by weight overbased calcium salicylate using fatty acid in the conversion step.

Briefly, the greases of this invention can be formed by heating overbased calcium salicylate, amorphous calcium carbonate, and a converting agent comprising a fatty acid of 12 to 24 carbon atoms in an oleaginous media and adding sufficient water, alcohol, and carbon dioxide to convert the amorphous calcium carbonate to calcite crystals and then, preferably, adding a boric acid compound thereto and forming a calcium borate in situ.

The process of the present invention is preferably carried out in the presence of a detergent sulfonic acid. Suitable detergent sulfonic acids useful in the production of the calcium salicylates are oil-soluble and can be produced by sulfonating a feedstock that is most commonly a linear or branched chain alkyl benzene, such as a mixture of mono- and di-alkyl benzenes in which the alkyl radical contains largely from 12 to 40 carbon atoms, generally mixtures of such alkyl radicals. The sulfonic acids are generally produced in solution in a volatile inert organic solvent such as Varsol or naphtha or mineral spirits. In the practice of the present invention, it is particularly advantageous to utilize alkyl benzene sulfonic acids containing from 12 to 40 carbon atoms or mixtures containing primarily 12 to 40 carbon atoms as the alkyl radical(s). However, generally equivalent oil-soluble sulfonic acids can be used.

The overbased calcium salicylate of this invention can be prepared by any of the techniques employed in this art. Typically, these materials can be prepared by heating neutral calcium salicylate, oleaginous vehicle, hydrated lime, and a carbonation promoter, such as methanol, to the carbonation temperature and adding sufficient carbon dioxide to produce an overbased salicylate having the desired TBN. For purposes of this invention, the overbased calcium salicylate can have a metal ratio of about 4 to 20.

Soap forming aliphatic or fatty acids of 12 to 24 carbon atoms include dodecanoic acid, palmitic acid, stearic acid, oleic acid, ricinoleic acid, 12-hydroxystearic acid. The hydroxy fatty acids, particularly hydroxystearic acid, are preferred since they provide greater thickening to the greases than the unsubstituted fatty acids.

Suitable salt forming acids (complex forming acids) include mineral acids, such as hydrochloric acid, orthophosphoric acid, pyrophosphoric acid, sulfurous acid, and the like; organic acids of 1 to 7 carbon atoms, such as formic acid, acetic acid, propionic acid, valeric acid, oxalic acid, malonic acid, succinic acid, benzene sulfonic acid, and the like. Boric acid and boric acid formers are preferred since they provide the best grease properties. Converting agents useful in this invention include, among many others, water; alcohols, such as methanol, isopropyl alcohol, isobutanol, 1-methoxy-2-propanol, n-pentanol, and many others, or mixtures of such alcohols, or mixtures of alcohols with water; alkylene glycols; mono-lower alkyl ethers of alkylene glycols, such as monomethylether of ethylene glycol (methyl Cellosolve); and numerous others, such as lower aliphatic carboxylic acids exemplified by acetic acid and propionic acid; ketones; aldehydes; amines; phosphorus acids; alkyl and aromatic amines; certain imidazolines; alkanolamines; boron acids, including boric acid; tetraboric acid; metaboric acid; and esters of such boron acids; and, also, carbon dioxide as such or better, in combination with water.

Twenty-five percent by weight of the soap forming $C_{12}$ to $C_{24}$ fatty acid can be employed in the converting step with the remainder added to the converted grease. Splitting the fatty acid permits the production of grade 2 greases containing about 28 to 35% overbased calcium salicylate.

The high performance overbased calcium salicylate/calcium carbonate complex greases of the present invention preferably comprise calcium carbonate in the calcite form, oleaginous vehicle, minor proportions, by weight, of (a) a mineral or short chain 1 to 7 carbon atom calcium salt preferably calcium borate and (b) a calcium soap of a soap-forming aliphatic monocarboxylic acid containing at least 12 carbon atoms, said (a) and (b) ingredients being essentially homogeneously distributed through said complex grease, and in which the preferred embodiments utilize as the calcium soap the calcium soaps of hydroxy $C_{12}$-$C_{24}$ fatty acids, particularly 12-hydroxystearic acid, and in which the (a) ingredient is particularly advantageously formed in situ in said greases and preferably at least a portion of the (b) component is used as a converting agent in the conversion of amorphous calcium carbonate to crystalline calcium carbonate in the form of calcite and a portion of the (b) component is formed in situ after the conversion of amorphous calcium carbonate to calcite. The overbased calcium salicylate content of said greases, as produced by the processes described above and which are shown by the illustrative particular Examples set out below, will generally fall within the weight range of about 28 to 35%. The non-volatile oil, particularly a mineral or lubricating oil, content of the greases generally fall within the range of about 60 to about 70%, said proportions of said non-volatile oil constituting the total oil, that is, the added non-volatile oil plus that present in the overbased calcium salicylate composition. The boron acid or boric acid component, in the preferred greases of the invention, generally fall within the range of about 0.6 to about 3.5% with a particularly preferred range of about 1.2 to about 3.0%. The content of the soap-forming, aliphatic monocarboxylic acid, such as 12-hydroxystearic acid, used in the production of the calcium soap or soaps of the soap-forming aliphatic monocarboxylic acids or hydroxy-fatty acids containing at least 12 and up to about 24 carbon atoms, desirably $C_{12}$ to $C_{18}$ hydroxy-fatty acids, such as commercial hydroxystearic acid, generally fall within the range of about 1 to about 5%, with a particularly preferred range of about 1.3 to about 4%. The added lime or calcium hydroxide, the acid components to react with (boric acid and the soap-forming aliphatic monocarboxylic acids), is, by weight of the greases, in the range of about 0.5% to about 4%. However, in certain cases, in the preparation of the overbased calcium salicylate composition or solutions, there is commonly present in said compositions or solutions, after the carbonation step, or after the conversion of amorphous calcium carbonate to calcite free dispersed lime or calcium hydroxide in an amount of the order of about 1% to 1.5%, which may render it unnecessary to add any additional calcium oxide or hydrated lime to form the preferred calcium borate and the calcium soaps of the soap-forming aliphatic monocarboxylic acids, in which event the range of the lime or calcium hydroxide is, by weight of the greases, from 0% to about 5%. The content of calcium borate or its complex reaction mixture in the preferred grease compositions of the present invention is generally in the range of about 1.1% to about 6.7%; and that of the calcium soaps of the aliphatic monocarboxylic or fatty acids in the range of about 1.1% to about 6.5%. The relationship of the proportions of the boric acid, the lime or calcium hydroxide, and the soap-forming aliphatic monocarboxylic acids utilized in the production of the preferred greases of our present invention play a definite role in the production of optimum quality or effective greases. All of the foregoing percentages are in terms of wt. %, based on the weight of the greases as they are produced in accordance with the process or processes of our invention.

Various supplemental ingredients can, if desired, be incorporated into the greases of the present invention. Illustrative of such supplemental ingredients are oxidation inhibitors, such as phenyl alpha naphthylamine (PAN); viscosity index improvers, which may comprise certain polymers (Acryloid 155-C); and others for particular and generally known properties in greases or grease compositions.

The grease compositions of this invention can be prepared by either a one step or two step process in a manner similar to that described in U.S. Pat. No. 4,560,489, which is hereby incorporated by reference.

The preferred two step process comprises heating a Newtonian composition comprising overbased calcium salicylate, amorphous calcium carbonate, an oleaginous vehicle, and a combination of converting agents comprising a fatty acid of 12 to 24 carbon atoms and water, alcohol, and carbon dioxide under conditions favoring the formation of calcium carbonate crystals in the form of calcite crystals and not vaterite crystals. Vaterite crystals should be avoided. On the one hand, the calcite crystal form introduces non-Newtonian rheology, enhances yields, and adds to the high temperature properties of the grease, while the vaterite form is much less thixotropic and does not enhance high temperature grease properties. Accordingly, the conversion is carried out at about 100° to 300° F. (about 38° to about 149° C.), preferably 145° to 285° F. (about 63° to about 141° C.) and up to 85 psi or higher, preferably under autogenous pressure. Then, there is subsequently added thereto, at elevated temperatures, a boric acid compound admixed with or dissolved or partially dissolved in hot water, lime or calcium hydroxide, and additional soap-forming aliphatic monocarboxylic or fatty acid, such as a $C_{12}$-$C_{24}$ hydroxy fatty acid, not used in the conversion step to convert the boric acid to a calcium borate and to convert the aforesaid soap-forming acid or acids to calcium soaps, with or without supplemental optional ingredients.

In a 1-step procedure for producing the grease compositions of the present invention, there would be involved, for instance, broadly stated, preparing a single mixture of a highly overbased non-Newtonian calcium salicylate solution in a mineral oil or the like, then charging to this lime or calcium hydroxide, and a boric acid solution, soap-forming aliphatic monocarboxylic or fatty acid not used in the conversion step with or without supplemental ingredients, and thoroughly agitating the mixture. It will be understood that, in the 1-step procedure for producing the grease compositions of the present invention, for instance, where a mineral oil or like solution of a neutral calcium salicylate is overbased and converted in essentially 1-step to produce a non-Newtonian overbased calcium salicylate solution, which is further reacted with carbon dioxide, lime, boric acid, and a higher molecular weight monocarboxylic or fatty acid, e.g., 12-hydroxystearic acid, there is no intermediate isolation of overbased solution.

The preferred final high performance multipurpose calcium complex thixotropic grease or grease composition of this invention can be defined broadly as a product formed by a combination of (1) a highly overbased calcium salicylate of a high molecular weight oil-soluble salicylic acid, dissolved in an oil, particularly a mineral oil, containing extremely finely divided (at least mainly in excess of about 20 Å, and, more particularly, in various particle sizes in the range of about 50 or about 100 up to about 1000 Å, or even up to about 5,000 Å,) calcium carbonate mainly or essentially in the form of calcite; (2) a product formed by the reaction of boric acid with a calcium compound such as, e.g., calcium hydroxide or calcium carbonate (as calcite), presumably calcium borate or calcium borate intermingled or in some kind of complex in the grease or grease composition as a whole; and (3) a product formed from calcium hydroxide/calcium carbonate (as calcite) and a soap-forming aliphatic monocarboxylic or fatty acid, particularly a soap-forming hydroxy-fatty acid, such as 12 hydroxystearic acid, wherein the calcite particles are formed in the presence of a soap forming fatty acid.

As indicated above, cone penetration is determined by ASTM test (D217). More specifically, unworked penetration is measured when a sample of grease is brought to 77° F. (25° C.) and transferred to a standard cup; its surface is smoothed and the cone, in its penetrometer assembly, is placed so that its tip just touches the level grease surface. The cone and its movable assembly, weighing 150 grams, are permitted to rest on and drop into the grease for exactly five seconds. The distance dropped is measured.

Many greases change significantly in consistency when manipulated. A worked penetration is thus considered more significant as to service behavior than is unworked penetration. For this test, the grease is churned 60 round-trip strokes in a standard worker, again at 77° F. (25° C.). Air is driven out of the sample, its surface is smoothed, and again the penetration of the cores is measured.

The advantages and the important features of the present invention will be more apparent from the following examples.

EXAMPLES

Example 1

This example demonstrates the method of preparing high yield oil soluble calcite-core overbased calcium salicylate grease.

Three hundred and eighty grams of overbased calcium salicylate, 600 grams of 500 SUS viscosity oil, 44 grams of detergent dodecylbenzene sulfonic acid, 8 grams of 12-hydroxystearic acid, and 76 grams of water were heated to about 175-180° F. (about 79° to about 82° C.) with stirring in a two liter beaker. Acetic acid (2.6 grams) was pre-mixed with 34 grams of 1-methoxy-2-propanol and this mixture was added slowly to the two liter beaker. The reaction mixture was maintained at 180-200° F. (about 82° to about 93° C.) and carbon dioxide was delivered to it at a rate of 300 milliliters over a period of approximately 30 minutes, until thickening and conversion of amorphous calcium carbonate to calcite was complete as determined by infrared. After 26.4 grams of lime in 50 grams of water, 23.2 grams of boric acid in 50 grains of water, and 24 grams of 12-hydroxystearic acid were added, volatiles were stripped off at 300° F. (about 149° C.). The mixture was cooled and adjusted to Grade 2 with about 100 grams trim 500 SUS viscosity oil. The product, weighing 1208 grams, contained 31.5% starting overbased calcium salicylate and had a worked penetration of 265 to 295.

Comparative Example A

This example demonstrates the method of preparing high yield oil soluble calcite-core overbased calcium sulfonate grease, to highlight the differences from the preparation of the oil soluble calcite-core overbased calcium salicylate grease of this invention.

Three hundred and eighty grams of overbased calcium sulfonate, 73 grams of 2000 SUS viscosity oil, 142 grams of 500 SUS viscosity oil, 21.5 grams of detergent dodecylbenzene sulfonic acid, 31 grams of 12-hydroxystearic acid, and 38 grams of water were heated to about 140-145° F. (about 60° to about 63° C.) with stirring in a two liter beaker. Four and one-half grams of acetic acid was added slowly, followed by 16.7 grams of methanol. The reaction was maintained at 150 to 160° F. (about 66° to about 71° C.) until thickening and conversion of amorphous calcium carbonate to calcite was complete as determined by infrared. After 26.4 grams of lime in 50 grams water and 23.2 grams of boric acid in 50 grams water were added, volatiles were stripped off at 285° F. (about 141° C.), 4.6 grams of a mixture of phenyl α-naphthyl were added. The mixture was cooled and adjusted to Grade 2 with about 200 grams of trim 500 SUS viscosity oil. The product, weighing 1180 grams, contained 32.2% starting overbased calcium sulfonate and had a worked penetration of between 265 and 295.

Example 2

This example is given to illustrate the result of using the method of preparation of Comparative Example A, but substituting overbased amorphous calcium salicylate for the overbased amorphous calcium sulfonate used in that example.

When overbased amorphous calcium salicylate is used in the preparation disclosed in Comparative Example A, no conversion to calcite takes place.

Example 3

This example demonstrates the method of preparing low yield oil soluble calcite-core overbased calcium salicylate grease.

Three hundred and eighty grams of overbased calcium salicylate, 125 grams of 500 SUS viscosity oil, 21.5 grams of detergent dodecylbenzene sulfonic acid, and 38 grams of water were heated to about 175-180° F. with stirring in a two liter beaker. Acetic acid (4.5 grams) was pre-mixed with 17 grains of 1-methoxy-2-propanol, and the mixture was added slowly to the two liter beaker. The reaction mixture was maintained at 180-200° F. and carbon dioxide was delivered at a rate of 300 milliliters over a period of approximately 120 minutes, until thickening and conversion of amorphous calcium carbonate to calcite was complete as determined by infrared. After 26.4 grams of lime in 50 grams water, 23.2 grams of boric acid in 50 grams water, and 31 grams of 12-hydroxystearic acid were added, volatiles were stripped off at 300° F. The mixture was cooled and adjusted to Grade 2 with about 100 grams trim 500 SUS viscosity oil. The product weighed 910 grams, contained 41.8% starting overbased calcium salicylate, and had a worked penetration of 265 to 295.

Comparative Example B

This example demonstrates the method of preparing low yield oil soluble calcite-core overbased calcium sulfonate grease, to highlight the differences from the preparation of the oil soluble calcite-core overbased calcium salicylate grease of this invention.

Three hundred and eighty grams of overbased calcium sulfonate, 125 grams of 500 SUS viscosity oil, 21.5 grams of detergent dodecylbenzene sulfonic acid, and 38 grams of water were heated to about 140-145° F. with stirring in a two liter beaker. Four and a half grams of acetic acid was added slowly followed by 16.7 grams of methanol. The reaction mixture was maintained at 150 to 160° F. until thickening and conversion of amorphous calcium carbonate to calcite was complete as determined by infrared. After 26.4 grams of lime in 50 grams of water, 23.2 grams of boric acid in 50 grams of water, and 31 grams of 12-hydroxystearic acid were added, volatiles were stripped off at 285° F. and 4.6 grams of a mixture of phenyl α-naphthyl was added. The mixture was cooled and adjusted to Grade 2 with about 100 grams of trim 500 SUS viscosity oil. The product weighed 910 grams, contained 41.8% starting overbased calcium sulfonate, and had a worked penetration of between 265 and 295.

Example 4

This example is given to illustrate the result of using the method of preparation of Comparative Example B, but substituting the overbased amorphous calcium salicylate for the overbased amorphous calcium sulfonate used in that example.

When overbased amorphous calcium salicylate is used in the preparation disclosed in Comparative Example B, no conversion to calcite takes place.

Summary (1) Overbased amorphous calcium salicylates require carbon dioxide treatment for conversion to calcite.

(2) Overbased amorphous calcium salicylate will not convert to the oil soluble calcite form under the conditions for oil soluble calcite formation with overbased amorphous calcium sulfonate.

(3) A higher temperature is required to convert highly overbased salicylates to calcite, when 12-hydroxystearic acid is present during conversion. With this, a higher boiling alcohol is needed.

(4) 12-hydroxystearic acid must be split (about 25/75) before/after conversion to obtain calcite and maximize yield.

Testing of Ca Salicylate Grease

| Test | Method | Result |
|---|---|---|
| Consistency, 1/10 mm | ASTM D217 | |
| Unworked | | 284 |
| 60 Strokes | | 286 |
| 10K Strokes | | 292 |
| 100K Strokes | | 297 |
| Dropping Point, ° F. | ASTM D2265 | 483 |
| Crystal Structure | FTIR | Calcite |
| 4-Ball Wear, mm | ASTM D2266 | 0.53 |
| Cone Bleed @ 100° C., % | ASTM D6184 | 0.47 |
| Oil Separation in Storage, % | ASTM D1742 | 0.17 |
| Wheel Bearing Leakage, grams | ASTM D4290 | 4.26 |
| Bearing Life, hours | ASTM D3527 | |
| Run #1 | | 220 |
| Run #2 | | 240 |
| Salt Fog at 1 mil d.f.t. | ASTM B117 | 1088 |
| Bearing Corrosion | ASTM D1743 | Pass |
| Copper Corrosion, 24 hours at 100° C., rating | ASTM D4048 | 2 A |
| Dynamic Bearing Corrosion Test, 3% | IP220 | |
| Synthetic Sea Water, Rating | | 1,1 |
| Distilled Water | | 0,0 |
| 4-Ball EP D2596 | ASTM D2596 | |
| Weld | | 31.5 |
| Load Wear Index | | 46.2 |
| Water Washout @ 79° C. | ASTM D1264 | 2.5 |
| Low Temperature | ASTM D4693 | |
| Torque @ −40° C., N-m | | |
| Start | | 9.11 |
| 60 Seconds | | 5.55 |

When greases are produced using an overbased calcium salicylate detergent instead of an overbased calcium sulfonate detergent an improvement in high temperature grease performance is seen. For example, bearing life (D3527) is more than doubled when compared with a comparative sulfonate grease made using an overbased calcium sulfonate. Bearing life is an important measure of a greases high temperature performance and requires excellent mechanical stability, high dropping point and excellent antioxidant capability to provide suitable performance.

The invention has been described in detail with particular reference to preferred embodiments thereof, but it is understood that variations and modifications can be effected within the spirit and scope of the invention.

What is claimed is:

1. A process for forming a non-Newtonian oil composition in the form of a grease comprising an overbased calcium salicylate and solid particles of colloidally dispersed calcium carbonate in the form of calcite wherein the process comprises the steps of heating overbased calcium salicylate, amorphous calcium carbonate, and a converting agent comprising a fatty acid of twelve to twenty-four carbon atoms in an oleaginous medium, and then adding sufficient water, alcohol, and carbon dioxide to the mixture to complete the conversion of the amorphous calcium carbonate to calcite.

2. The process of claim 1 wherein the fatty acid comprises hydroxystearic acid.

3. The process of claim 2 wherein substantially all of the hydroxystearic acid in the grease is present during the conversion of the amorphous calcium carbonate to calcite.

4. A process for forming a non-Newtonian oil composition in the form of a grease comprising an overbased calcium salicylate, solid particles of colloidally dispersed calcium carbonate in the form of calcite, and calcium borate wherein the process comprises the steps of (1) heating overbased calcium salicylate, amorphous calcium carbonate, and a combination of converting agents comprising water, alcohol, and carbon dioxide and a fatty acid of twelve to twenty-four carbon atoms in an oleaginous vehicle under conditions favoring the formation of calcium carbonate crystals in the form of calcite crystals, and (2) reacting said product of step 1 with components comprising a boric acid compound to develop the grease like properties.

5. The process of claim 4 wherein the fatty acid comprises hydroxystearic acid.

6. A high performance calcium borate modified overbased calcium salicylate/calcium carbonate complex grease comprising overbased calcium salicylate, oleaginous vehicle, calcium carbonate in the calcite form, a calcium borate, and a calcium soap of a soap-forming aliphatic monocarboxylic acid containing at least twelve carbon atoms, wherein the calcium borate and the calcium soap are substantially homogeneously distributed through the grease, and at least a portion of the calcium soap acts as a converting agent along with carbon dioxide in the conversion of amorphous calcium carbonate to crystalline calcium carbonate in the form of calcite.

7. The composition of claim 6 wherein the soap-forming aliphatic monocarboxylic acid comprises hydroxystearic acid.

* * * * *